US009488414B2

(12) United States Patent
Zhang et al.

(10) Patent No.: US 9,488,414 B2
(45) Date of Patent: Nov. 8, 2016

(54) CRUCIBLE HEATING APPARATUS AND METHOD

(71) Applicant: SHENZHEN CHINA STAR OPTOELECTRONICS TECHNOLOGY CO., LTD., Shenzhen, Guangdong (CN)

(72) Inventors: Xindi Zhang, Shenzhen (CN); Kuan-Cheng Lee, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 190 days.

(21) Appl. No.: 14/240,349

(22) PCT Filed: Jan. 23, 2014

(86) PCT No.: PCT/CN2014/071248

§ 371 (c)(1),
(2) Date: Feb. 21, 2014

(87) PCT Pub. No.: WO2015/051608

PCT Pub. Date: Apr. 16, 2015

(65) Prior Publication Data

US 2015/0153108 A1 Jun. 4, 2015

(30) Foreign Application Priority Data

Oct. 12, 2013 (CN) ..... 2013 1 0476481

(51) Int. Cl.
*H05B 1/02* (2006.01)
*H05B 3/62* (2006.01)
(Continued)

(52) U.S. Cl.
CPC ..... *F27D 19/00* (2013.01); *F22B 1/28* (2013.01); *F27B 14/06* (2013.01); *F27B 14/20* (2013.01);
(Continued)

(58) Field of Classification Search
CPC ..... F27B 14/06; F27B 17/02; F27B 14/20; F22B 1/28; F27D 11/02; F27D 21/0028; F27D 19/00; F27D 2019/0075
USPC ..... 373/135, 118, 117, 109, 115, 122, 136; 392/389; 219/395, 410, 413, 420, 422; 137/13, 334
See application file for complete search history.

(56) References Cited

U.S. PATENT DOCUMENTS 2,006,685 A * 7/1935 Moore ..... F27D 11/02 373/109

(Continued)

FOREIGN PATENT DOCUMENTS

CN 1078548 A 11/1993
CN 1740352 A 3/2006

(Continued)

OTHER PUBLICATIONS

International Search Report dated Jul. 18, 2014, issued to International Application No. PCT/CN2014/071248.

(Continued)

*Primary Examiner* — Hung D Nguyen
(74) *Attorney, Agent, or Firm* — Stein IP, LLC

(57) ABSTRACT

A crucible heating apparatus includes a crucible, a metal barrel around the crucible, a heating wire wound between the metal barrel and the crucible, a measuring unit for measuring the position of the liquid level of a material in the crucible and a controller, and the apparatus is characterized in that the heating wire includes at least two subsections arranged along the longitudinal direction, and the controller controls the heating power of each subsection respectively, thus dividing the crucible into at least two corresponding temperature control zones. In such a manner, by disposing a plurality of subsections of the heating wire and the corresponding temperature control zones of the crucible, the temperature of each position of the crucible is accurately controlled. A crucible heating method is also provided.

10 Claims, 3 Drawing Sheets

(51) Int. Cl.

| | |
|---|---|
| ***F27D 19/00*** | (2006.01) |
| ***F27B 14/06*** | (2006.01) |
| ***F22B 1/28*** | (2006.01) |
| ***F27D 11/02*** | (2006.01) |
| ***F27D 21/00*** | (2006.01) |
| ***F27B 14/20*** | (2006.01) |
| ***F27B 17/02*** | (2006.01) |

(52) U.S. Cl.

CPC ..... *F27B 17/02* (2013.01); *F27D 11/02* (2013.01); *F27D 21/0028* (2013.01); *F27D 2019/0075* (2013.01)

(56) References Cited

U.S. PATENT DOCUMENTS

| | | | | |
|---|---|---|---|---|
| 2,898,436 | A * | 8/1959 | Lawler | G05D 23/22 373/135 |
| 4,734,127 | A * | 3/1988 | Iuchi | C22B 21/06 373/111 |
| 2006/0173646 | A1 | 8/2006 | Tanaka et al. | 702/130 |
| 2013/0247998 | A1 * | 9/2013 | Ohkubo | F27B 14/061 137/13 |

FOREIGN PATENT DOCUMENTS

| | | | |
|---|---|---|---|
| CN | 102051674 | A | 5/2011 |
| CN | 202024601 | U | 11/2011 |
| CN | 202030860 | U | 11/2011 |
| CN | 102312200 | A | 1/2012 |
| CN | 203053224 | U | 7/2013 |
| JP | 2000-205758 | A | 7/2000 |
| JP | 2003-65679 | A | 3/2003 |
| WO | WO 2009/064731 | A2 | 5/2009 |

OTHER PUBLICATIONS

Chinese Search Report dated Sep. 17, 2014, issued to the corresponding Chinese Application No. 2013104764819.

* cited by examiner

CRUCIBLE HEATING APPARATUS AND METHOD

FIELD OF THE INVENTION

The present disclosure relates to crucible heating apparatus and method with an improved temperature control function.

BACKGROUND OF THE INVENTION

A crucible is a utensil or a melting tank made of an extremely refractory material, such as clay, graphite, porcelain clay, quartz or infusible metallic iron. The crucible is generally a ceramic deep-bottom bowl-like container. A crucible is often used when solid objects need to be heated over heavy fire, as it can bear a higher temperature compared with glassware. During the use of a crucible, a crucible cover is generally obliquely placed on the crucible to prevent the heated substance from splashing and allow air to freely get in and out for possible oxidation reactions. The crucible is generally held on a pipeclay triangle for direct heating over fire due to its small bottom. The crucible may be placed on the pipeclay triangle vertically or obliquely, according to experimental needs. The heated crucible can not be immediately put on a cold metal desktop, in case it would be broken due to drastic cooling.

FIG. 1 shows a zinc furnace with a crucible in the prior art. The zinc furnace includes a furnace body 1. A hearth 2 is arranged in the furnace body 1, and a furnace pot 6 is arranged on the upper part of the furnace body 1. Furthermore, an electric furnace plate 3 is arranged at the bottom of the hearth 2, while a heating wire 4 is arranged in the inner cavity of the hearth 2. With reference to FIG. 1, the lower part of a crucible 5 in the hearth 2 is in contact with the heating wire 4, while the upper part of the crucible 5 is located at the bottom of the furnace pot 6. A heat preservation layer 7 is arranged in the furnace body 1 outside the hearth 2. A thermocouple 8 penetrates through the heat preservation layer 7 and the wall of the hearth 2 with one end located in the hearth 2 and the other connected with a control cabinet 9.

When heated with the cubicle, a material could be evaporated till being completely consumed, and the total quantity of the material is determined by the volume of the crucible. However, the crucible heating apparatus used in the prior art generally adopts an integral heating system, wherein the temperature difference over the crucible stays constant. In this case, the bigger the crucible is, or the longer its longitudinal length is, the more difficult it is to control the temperature difference. Meanwhile, when used for evaporation, the crucible leads to certain defects, such as non-uniform melting along the radius of the crucible, rate instability caused by a sudden boiling associated with the length of the crucible, material pyrolysis caused by slow heat conduction inside the material, etc.

Accordingly, although related heating apparatuses and methods in the prior art are able to monitor the temperature in the furnace, i.e. the crucible, through a monitoring element and adjust the temperature through an external controller, the temperature control device, which is relatively simple, can only roughly adjust the temperature in the crucible on the whole, leaving the problems of non-uniform heat transfer and thus non-uniform temperature distribution unsolved. Moreover, as the temperature control device in the prior art controls the temperature in the crucible on the whole, the temperature of each zone of the whole crucible can not be controlled exactly. Local temperature abnormities due to the limited number of sampling points may lead to misjudgment of the temperature control device, thus causing heating failure and even dangerous accidents.

SUMMARY OF THE INVENTION

As mentioned above, there are still certain defects in the prior art. Related heating apparatuses in the prior art have relatively simple temperature control devices, and related temperature control methods are also relatively simple, wherein the temperature in the crucible can only be roughly adjusted on the whole, leaving the problems of non-uniform heat transfer and non-uniform temperature distribution in the crucible unsolved. Moreover, the temperature control device integrally controls the temperature in the crucible in the prior art, and thus the temperature of each zone of the whole crucible can not be finely controlled. Local temperature abnormities due to the limited number of sampling points may lead to misjudgment of the temperature control device, thus causing heating failure and even dangerous accidents.

When the crucible is used for heating, a material could be evaporated till being completely consumed, and the total quantity of the material is determined by the volume of the crucible. The bigger the crucible is, or the longer the longitudinal length is, the more difficult it is to control the temperature difference. Meanwhile, when used for evaporation, the crucible leads to certain defects, such as non-uniform melting along the radius of the crucible, rate instability caused by a sudden boiling associated with the length of the crucible, material pyrolysis caused by slow heat conduction inside the material, etc.

To solve the problems in the prior art, the following factors need to be considered:

firstly, the crucible can not be too thick, for the temperature of the material close to the wall of the crucible is higher and the temperature of the material away from the wall of the crucible is lower, thus causing non-uniform melting;

secondly, when the material is melted, the melted portion can not be too far from the liquid level, otherwise, bubbles in the material are difficult to discharge in short time, thus causing a sudden boiling;

thirdly, the transverse or longitudinal temperature difference in the crucible can not be too high, otherwise, the material with relatively low evaporation start temperature and pyrolysis temperature would be easily cracked.

Therefore, $$\text{Temperature of material} = \frac{\text{Heating value of coil} - \text{Heat loss of contact transfer} - \text{Heat loss of crucible}}{\text{Specific heat of material} \times \text{Shape parameter of crucible}}.$$

Accordingly, the present disclosure proposes crucible heating apparatus and a corresponding method. In the present invention, a plurality of independent temperature control zones are provided, with each separately controlled in a specific manner. In this way, the control is more accurate, and the probability of accidents is greatly reduced.

The present disclosure proposes crucible heating apparatus. In embodiment 1, the apparatus includes a crucible, a metal barrel placed around the crucible, a heating wire wound between the metal barrel and the crucible, a measuring unit for measuring the position of the liquid level of a material in the crucible and a controller, and the apparatus is characterized in that the heating wire includes at least two subsections arranged along the longitudinal direction, and the controller controls the heating power of each subsection respectively, thus dividing the crucible into at least two corresponding temperature control zones. In such a manner, by disposing a plurality of subsections of the heating wire and the corresponding temperature control zones of the crucible, the temperature of each position of the crucible is accurately controlled. Furthermore, the defects of non-uniform melting of the material, sudden boiling and even pyrolysis of the material and the like, which can not be solved in the prior art, may be effectively avoided, thus the material filling quantity of the crucible is increased, the frequency of opening the cavity is reduced, and the utilization rate of a machine stand is improved.

In embodiment 2 improved according to embodiment 1, the coils of the heating wire are uniformly distributed in the longitudinal direction. In this case, the controller can be conveniently provided with corresponding controlling programs, thus avoiding possible program bugs.

In embodiment 3 improved according to embodiment 1 or 2, a metal covering member is arranged at a first end of the metal barrel, and a metal layer or a heat insulating layer is arranged at an opposite, second end of the metal barrel. This solution effectively prevents the heat in the crucible from escaping into the ambient environment.

In embodiment 4 improved according to any of embodiments 1 to 3, the crucible is cylindrical in shape, and the diameter of the crucible is less than 10 cm. If the crucible is too thick, the temperature of the material close to the wall of the crucible would be higher, and the temperature of the material away from the wall of the crucible would be lower, which would result in non-uniform melting. Therefore, preferably, the diameter of the crucible is designed to be less than 10 cm.

In embodiment 5 improved according to any of embodiments 1 to 4, the measuring unit includes a gravity sensor located beneath the crucible or a Cygnus system. The gravity sensor may be arranged below the crucible, and the reduced volume of the material is monitored through the gravity sensor, so that the position of the liquid level is acquired. On the other hand, the evaporation rate, the evaporation time and the evaporation region can be processed using the Cygnus system to calculate the quantity of the evaporated material, as a result of which the position of the liquid level can be acquired.

The present disclosure also proposes a crucible heating method, including the following steps: (a) providing the crucible heating apparatus according to the present disclosure; (b) placing the material to be evaporated into the crucible; (c) setting the initial heating powers of different subsections of the heating wire respectively; (d) evaporating the material and monitoring the position of the liquid level of the material in the crucible through the measuring unit; and (e) adjusting the heating powers of the different subsections of the heating wire according to the position of the liquid level of the material, till the material is evaporated to a desired degree.

Preferably, the heating wire is provided with more than ten subsections, and the temperature difference within a single temperature control zone corresponding to each subsection is controlled within 2° C. Thus, the longitudinal temperature difference can be flexibly controlled, as a result of which excessive longitudinal temperature difference can be prevented.

Further preferably, the evaporation behavior is monitored through a Cygnus system, the time period required for the liquid level to decline by 10% is acquired, and the heating powers of all the subsections of the heating wire are changed within the time period to adapt to the decline of the liquid level. Thus, rate instability of an evaporation source due to sudden change of power can be prevented.

Further preferably, the heating powers of some subsections of the heating wire are adjusted according to the current evaporation rate to ensure the stability of the evaporation rate.

Further preferably, the following adjustment is performed in step (e):

when the surplus of the material is between 90% and 100%, the position below 70% of the crucible is heated, wherein the bottom of the crucible is heated to the melting point of the material, the position of 70% is heated to the evaporation start point of the material, the temperature of the position between the bottom of the crucible and the position of 70% successively rises from bottom to top, and the temperature control zone of the position between 70% and 100% is kept in a state that the temperature successively rises from bottom to top and the temperature difference does not exceed 15° C.;

when the surplus of the material is between X % and (X+10)%, the position below (X−20)% of the crucible is heated, wherein the bottom of the crucible is heated to the melting point of the material, the position of (X−20)% is heated to the evaporation start point of the material, the temperature of the position between the bottom of the crucible and the position of (X−20)% successively rises from bottom to top, the temperature control zone of the position between (X−20)% and (X+10)% is kept in a state that the temperature successively rises from bottom to top and the temperature difference does not exceed 15° C., and the temperature of the position above (X+10)% equals to that of the position of (X+10)%, and wherein X is 30, 40, 50, 60, 70 and 80 respectively;

when the surplus of the material is between 10% and 30%, the bottom of the crucible is heated to the evaporation start point of the material, wherein the temperature control zone between the bottom of the crucible and the position of 30% is kept in a state that the temperature successively rises from bottom to top and the temperature difference does not exceed 15° C., and the temperature of the position above 30% equals to that of the position of 30%, and wherein the above percentage designates the volume percent of the quantity of the material to the volume of the crucible.

In this way, when the material is melted, the melted portion is not too far from the liquid level, and bubbles in the material are quickly discharged, as a result of which sudden boiling is effectively avoided. Meanwhile, the transverse or longitudinal temperature difference in the crucible would not be too high, thus the material with relatively low evaporation start temperature and pyrolysis temperature can be effectively evaporated without a pyrolysis of the same.

The apparatus and the method according to the present disclosure can effectively avoid the defects of non-uniform melting of the material, sudden boiling and even pyrolysis of the material etc, which can not be solved in the prior art, thus increasing the material filling quantity of the crucible, reducing the frequency of pening the cavity and improving the utilization rate of a machine stand.

The above-mentioned technical features may be combined in various appropriate manners or substituted by equivalent technical features, as long as the objective of the present disclosure can be fulfilled.

BRIEF DESCRIPTION OF THE DRAWINGS

The present disclosure will be described in more detail below based on merely nonfinite examples with reference to the accompanying drawings. Wherein.

Figure 1:
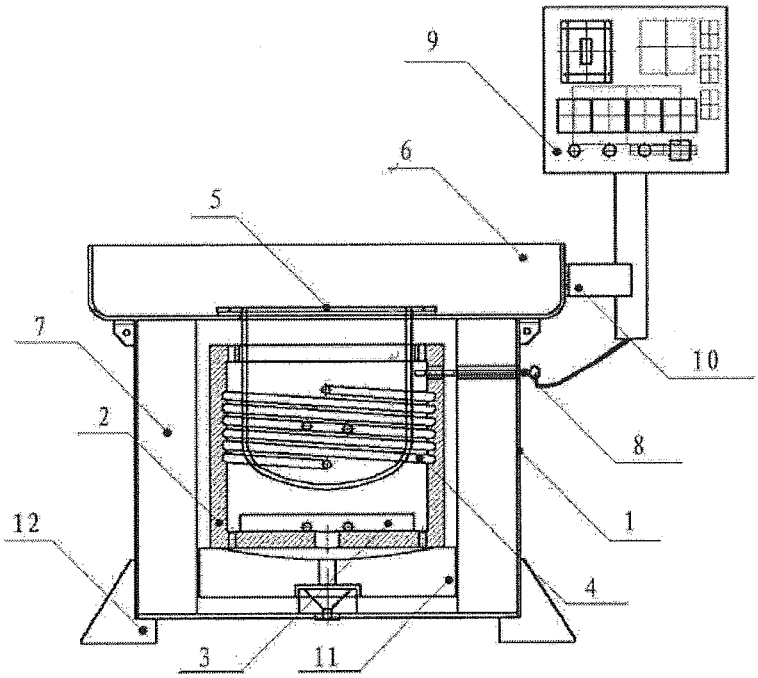
Fig. 1 (Prior Art)
FIG. 1 shows crucible heating apparatus in the prior art.

In the drawings, the same components are indicated by the same reference signs. The accompanying drawings are not drawn in an actual scale.

DETAILED DESCRIPTION OF THE EMBODIMENTS

The present disclosure will be introduced in detail below with reference to the accompanying drawings.

Figure 2:
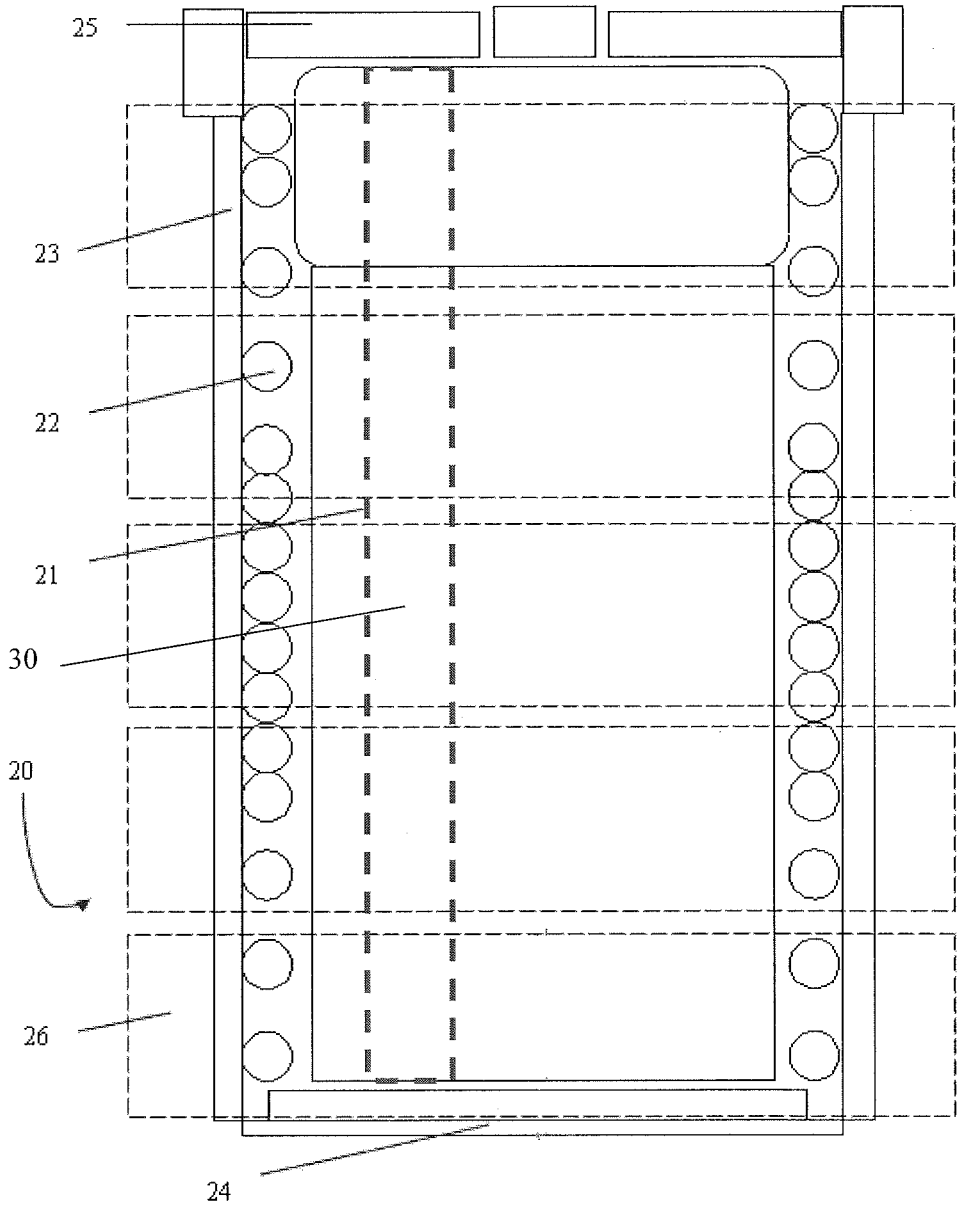
FIG. 2 shows an example of crucible heating apparatus according to the present disclosure.

FIG. 2 shows a crucible heating apparatus 20 according to the present disclosure. The crucible heating apparatus 20 includes a crucible 21, and the material to be evaporated is placed in the crucible 21.

The apparatus 20 further includes a metal barrel 23 around the outside of the crucible 21 and a heating wire 22 wound between the metal barrel 23 and the crucible 21. The heating wire 22 is configured to heat the crucible 21 and the material to be evaporated inside the crucible 21. The temperatures of different positions of the crucible 21 are determined by heating values of adjacent heating coils of the heating wire 22. The heating wire 22 is heated up by electrifying with the crucible 21 being heated, and the material in the crucible 21 would be evaporated when certain temperature is reached.

The apparatus 20 further includes a measuring unit 30 for measuring the position of the liquid level of the material in the crucible and a controller. The measuring unit 30 may include a gravity sensor located beneath the crucible or a Cygnus system.

According to the present disclosure, the heating wire 22 includes at least two subsections arranged along the longitudinal direction, and the controller can control the heating power of each subsection respectively, thus dividing the crucible 21 into at least two corresponding temperature control zones 26.

Figure 3:
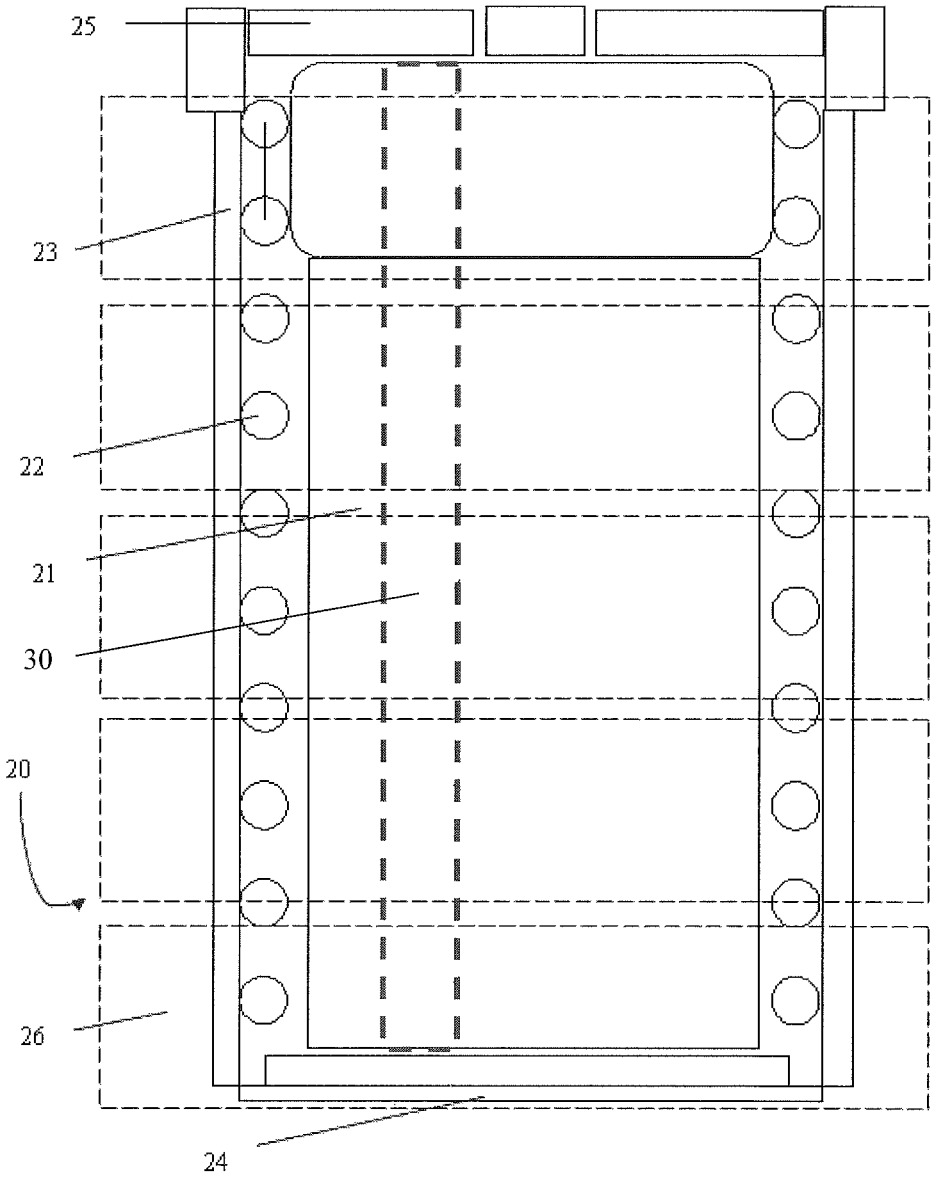
FIG. 3 shows another example of the crucible heating apparatus according to the present disclosure.

In a preferred example, as shown in FIG. 3, the coils of the heating wire 22 are uniformly distributed in the longitudinal direction of the apparatus 20. In this case, the controller can be conveniently provided with corresponding controlling programs, thus avoiding possible program bugs.

With reference to FIG. 2, a metal covering member 25 is arranged at a first end (the upper end shown in the figure) of the metal barrel 23 to prevent heat loss, and a metal layer or a heat insulating layer 24 is arranged at a second end (the lower end shown in the figure) of the metal barrel 23 to prevent heat loss.

In the apparatus 20 according to the present disclosure, the crucible 21 may be cylindrical in shape, and the diameter of the crucible 21 can be less than 10 cm. In this way, it is intended to avoid affecting the transverse heat transfer of the material. If the crucible 21 is excessively thick, the temperature of the material close to the wall of the crucible 21 would be higher, and the temperature of the material away from the wall of the crucible 21 would be lower, which would cause non-uniform melting. Therefore, the diameter of the crucible 21 is preferably less than 10 cm.

The present disclosure also proposes a crucible heating method, including the following steps:

Step 1, providing the crucible heating apparatus 20 according to the present disclosure.

Step 2, placing the material to be evaporated into the crucible 21.

Step 3, setting the initial heating powers of different subsections of the heating wire 22 respectively.

Step 4, evaporating the material and monitoring the position of the liquid level of the material in the crucible 21 through a measuring unit.

The specific manner for monitoring the position of the liquid level of the material may provide a gravity sensor arranged below the crucible, so that the loss of the material can be monitored through the gravity sensor and thus the position of the liquid level can be acquired.

The evaporation rate, evaporation time and evaporation range may be further processed through a Cygnus system to obtain the quantity of the evaporated material, thus the position of the liquid level is acquired.

Step 5, adjusting the heating powers of the different subsections of the heating wire 22 according to the position of the liquid level of the material till the material is evaporated to a desired degree.

In step 5, the specific adjusting method may include a fine control method, namely, the heating wire 22 may be provided with more than ten subsections, each independent subsection is controlled by a respective circuit, and the temperature difference within a single temperature control zone corresponding to each subsection is controlled within 2° C.

In step 5, the specific adjusting method may include a gradient adjusting method, namely, the evaporation behavior is monitored through the Cygnus system, the time period required for the liquid level to decline by 10% is acquired, and the heating powers of all the subsections of the heating wire 22 are changed within the time period to adapt to the decline of the liquid level. Thus, rate instability of an evaporation source due to sudden change of power can be prevented.

In step 5, the specific adjusting method may also include a power finely adjusting method, namely, the heating powers of some subsections of the heating wire 22 are adjusted according to the current evaporation rate to ensure the stability of the evaporation rate. If a rate control manner is adopted for evaporation, the heating system is permitted to finely adjust the subsections of the heating wire 22 corresponding to a part of temperature control zones according to the current evaporation rate, so as to ensure the stability of the rate.

In step 5, the specific adjusting method may also include a software control method, namely, the heating power of each subsection of the heating wire 22 can be controlled through software, and rising and falling adjustment is coordinated through the software.

In a preferred example, the heating power of each subsection of the heating wire 22 is adjusted in the following manner. It should be noted that the following percentage designates the volume percent of the quantity of the material to the volume of the crucible:

when the surplus of the material is between 90% and 100%, the position below 70% of the crucible is heated, wherein the bottom of the crucible is heated to the melting point of the material, the position of 70% is heated to the evaporation start point of the material, the temperature of the position between the bottom of the crucible and the position of 70% successively rises from bottom to top, and the temperature control zone of the position between 70% and 100% is kept in a state that the temperature successively rises from bottom to top and the temperature difference does not exceed 15° C.;

when the surplus of the material is between 80% and 90%, the position below 60% of the crucible is heated, wherein the bottom of the crucible is heated to the melting point of the material, the position of 60% is heated to the evaporation start point of the material, the temperature of the position between the bottom of the crucible and the position of 60% successively rises from bottom to top, the temperature control zone of the position between 60% and 90% is kept in a state that the temperature successively rises from bottom to top and the temperature difference does not exceed 15° C., and the temperature of the position above 90% equals to that of the position of 90%;

when the surplus of the material is between 70% and 80%, the position below 50% of the crucible is heated, wherein the bottom of the crucible is heated to the melting point of the material, the position of 50% is heated to the evaporation start point of the material, the temperature of the position between the bottom of the crucible and the position of 50% successively rises from bottom to top, the temperature control zone of the position between 50% and 80% is kept in a state that the temperature successively rises from bottom to top and the temperature difference does not exceed 15° C., and the temperature of the position above 80% equals to that of the position of 80%;

when the surplus of the material is between 60% and 70%, the position below 40% of the crucible is heated, wherein the bottom of the crucible is heated to the melting point of the material, the position of 40% is heated to the evaporation start point of the material, the temperature of the position between the bottom of the crucible and the position of 40% successively rises from bottom to top, the temperature control zone of the position between 40% and 70% is kept in a state that the temperature successively rises from bottom to top and the temperature difference does not exceed 15° C., and the temperature of the position above 70% equals to that of the position of 70%;

when the surplus of the material is between 50% and 60%, the position below 30% of the crucible is heated, wherein the bottom of the crucible is heated to the melting point of the material, the position of 30% is heated to the evaporation start point of the material, the temperature of the position between the bottom of the crucible and the position of 30% successively rises from bottom to top, the temperature control zone of the position between 30% and 60% is kept in a state that the temperature successively rises from bottom to top and the temperature difference does not exceed 15° C., and the temperature of the position above 60% equals to that of the position of 60%;

when the surplus of the material is between 40% and 50%, the position below 20% of the crucible is heated, wherein the bottom of the crucible is heated to the melting point of the material, the position of 20% is heated to the evaporation start point of the material, the temperature of the position between the bottom of the crucible and the position of 20% successively rises from bottom to top, the temperature control zone of the position between 20% and 50% is kept in a state that the temperature successively rises from bottom to top and the temperature difference does not exceed 15° C., and the temperature of the position above 50% equals to that of the position of 50%;

when the surplus of the material is between 30% and 40%, the position below 10% of the crucible is heated, wherein the bottom of the crucible is heated to the melting point of the material, the position of 10% is heated to the evaporation start point of the material, the temperature of the position between the bottom of the crucible and the position of 10% successively rises from bottom to top, the temperature control zone of the position between 10% and 40% is kept in a state that the temperature successively rises from bottom to top and the temperature difference does not exceed 15° C., and the temperature of the position above 40% equals to that of the position of 40%;

when the surplus of the material is between 10% and 30%, the bottom of the crucible is heated to the evaporation start point of the material, wherein the temperature control zone between the bottom of the crucible and the position of 30% is kept in a state that the temperature successively rises from bottom to top and the temperature difference does not exceed 15° C., and the temperature of the position above 30% equals to that of the position of 30%.

Although the present disclosure has been described with reference to the preferred examples, various modifications could be made to the present disclosure without departing from the scope of the present disclosure and components in the present disclosure could be substituted by equivalents. The present disclosure is not limited to the specific examples disclosed in the description, but includes all technical solutions falling into the scope of the claims.

The invention claimed is:

1. A crucible heating apparatus, including a crucible, a metal barrel placed around the crucible, a heating wire wound between the metal barrel and the crucible, a measuring unit for measuring the position of the liquid level of a material in the crucible, and a controller, wherein the heating wire includes at least two subsections arranged along the longitudinal direction, and the controller controls a heating power of each subsection respectively, thus dividing the crucible into at least two corresponding temperature control zones, the controller is configured so that when a surplus of the material is between 90% and 100%, the position below 70% of the crucible is heated, wherein a bottom of the crucible is heated to a melting point of the material, the position of 70% is heated to an evaporation start point of the material, the temperature of the position between the bottom of the crucible and the position of 70% successively rises from bottom to top, and the temperature control zone of the position between 70% and 100% is kept in a state that the temperature successively rises from bottom to top and the temperature difference does not exceed 15° C.;

when the surplus of the material is between X % and (X+10)%, the position below (X−20)% of the crucible is heated, wherein the bottom of the crucible is heated to the melting point of the material, the position of (X−20)% is heated to the evaporation start point of the material, the temperature of the position between the bottom of the crucible and the position of (X−20)% successively rises from bottom to top, the temperature control zone of the position between (X−20)% and (X+10)% is kept in a state that the temperature successively rises from bottom to top and the temperature difference does not exceed 15° C., and the temperature of the position above (X+10)% equals to that of the position of (X+10)%, and wherein X is 30, 40, 50, 60, 70 and 80 respectively;

when the surplus of the material is between 10% and 30%, the bottom of the crucible is heated to the evaporation start point of the material, wherein the temperature control zone between the bottom of the crucible and the position of 30% is kept in a state that the temperature successively rises from bottom to top and the temperature difference does not exceed 15° C., and the temperature of the position above 30% equals to that of the position of 30%, and wherein the above percentage designates the volume percent of the quantity of the material to the volume of the crucible.

2. The heating apparatus according to claim 1, wherein coils of the heating wire are uniformly distributed in the longitudinal direction.

3. The heating apparatus according to claim 1, wherein a metal covering member is arranged at a first end of the metal barrel, and a metal layer or a heat insulating layer is arranged at an opposite, second end of the metal barrel.

4. The heating apparatus according to claim 1, wherein the crucible is cylindrical in shape, and the diameter of the crucible is less than 10 cm.

5. A crucible heating method, including the following steps:

(a) providing a crucible heating apparatus, including a crucible, a metal barrel placed around the crucible, a heating wire wound between the metal barrel and the crucible, a measuring unit for measuring the position of the liquid level of a material in the crucible, and a controller, wherein the heating wire includes at least two subsections arranged along the longitudinal direction, and the controller controls a heating power of each subsection respectively, thus dividing the crucible into at least two corresponding temperature control zones;

(b) placing the material to be evaporated into the crucible;

(c) setting an initial heating powers of different subsections of the heating wire respectively;

(d) evaporating the material and monitoring the position of the liquid level of the material in the crucible through the measuring unit; and (e) adjusting the heating powers of the different subsections of the heating wire according to the position of the liquid level of the material, till the material is evaporated to a desired degree, wherein the following adjustment is performed in step (e):

when a surplus of the material is between 90% and 100%, the position below 70% of the crucible is heated, wherein a bottom of the crucible is heated to a melting point of the material, the position of 70% is heated to an evaporation start point of the material, the temperature of the position between the bottom of the crucible and the position of 70% successively rises from bottom to top, and the temperature control zone of the position between 70% and 100% is kept in a state that the temperature successively rises from bottom to top and the temperature difference does not exceed 15° C.;

when the surplus of the material is between X % and (X+10)%, the position below (X−20)% of the crucible is heated, wherein the bottom of the crucible is heated to the melting point of the material, the position of (X−20)% is heated to the evaporation start point of the material, the temperature of the position between the bottom of the crucible and the position of (X−20)% successively rises from bottom to top, the temperature control zone of the position between (X−20)% and (X+10)% is kept in a state that the temperature successively rises from bottom to top and the temperature difference does not exceed 15° C., and the temperature of the position above (X+10)% equals to that of the position of (X+10)%, and wherein X is 30, 40, 50, 60, 70 and 80 respectively;

when the surplus of the material is between 10% and 30%, the bottom of the crucible is heated to the evaporation start point of the material, wherein the temperature control zone between the bottom of the crucible and the position of 30% is kept in a state that the temperature successively rises from bottom to top and the temperature difference does not exceed 15° C., and the temperature of the position above 30% equals to that of the position of 30%, and wherein the above percentage designates the volume percent of the quantity of the material to the volume of the crucible.

6. The method according to claim 5, wherein the heating wire is provided with more than ten subsections, and the temperature difference within a single temperature control zone corresponding to each subsection is controlled within 2° C.

7. The method according to claim 5, wherein the heating powers of some subsections of the heating wire are adjusted according to the current evaporation rate to ensure the stability of the evaporation rate.

8. A crucible heating method, including the following steps:

(a) providing the crucible heating apparatus, including a crucible, a metal barrel placed around the crucible, a heating wire wound between the metal barrel and the crucible, a measuring unit for measuring the position of the liquid level of a material in the crucible, and a controller, wherein the heating wire includes at least two subsections arranged along the longitudinal direction, and the controller controls a heating power of each subsection respectively, thus dividing the crucible into at least two corresponding temperature control zones, wherein coils of the heating wire are uniformly distributed in the longitudinal direction;

(b) placing the material to be evaporated into the crucible;

(c) setting an initial heating powers of different subsections of the heating wire respectively;

(d) evaporating the material and monitoring the position of the liquid level of the material in the crucible through the measuring unit; and (e) adjusting the heating powers of the different subsections of the heating wire according to the position of the liquid level of the material, till the material is evaporated to a desired degree, wherein the following adjustment is performed in step (e):

when a surplus of the material is between 90% and 100%, the position below 70% of the crucible is heated, wherein a bottom of the crucible is heated to a melting point of the material, the position of 70% is heated to an evaporation start point of the material, the temperature of the position between the bottom of the crucible and the position of 70% successively rises from bottom to top, and the temperature control zone of the position between 70% and 100% is kept in a state that the temperature successively rises from bottom to top and the temperature difference does not exceed 15° C.;

when the surplus of the material is between X % and (X+10)%, the position below (X−20)% of the crucible is heated, wherein the bottom of the crucible is heated to the melting point of the material, the position of (X−20)% is heated to the evaporation start point of the material, the temperature of the position between the bottom of the crucible and the position of (X−20)% successively rises from bottom to top, the temperature control zone of the position between (X−20)% and (X+10)% is kept in a state that the temperature successively rises from bottom to top and the temperature difference does not exceed 15° C., and the temperature of the position above (X+10)% equals to that of the position of (X+10)%, and wherein X is 30, 40, 50, 60, 70 and 80 respectively;

when the surplus of the material is between 10% and 30%, the bottom of the crucible is heated to the evaporation start point of the material, wherein the temperature control zone between the bottom of the crucible and the position of 30% is kept in a state that the temperature successively rises from bottom to top and the temperature difference does not exceed 15° C., and the temperature of the position above 30% equals to that of the position of 30%, and wherein the above percentage designates the volume percent of the quantity of the material to the volume of the crucible.

9. The method according to claim 8, wherein the heating wire is provided with more than ten subsections, and the temperature difference within a single temperature control zone corresponding to each subsection is controlled within 2° C.

10. The method according to claim 8, wherein the heating powers of some subsections of the heating wire are adjusted according to the current evaporation rate to ensure the stability of the evaporation rate.

* * * * *